United States Patent [19]

Hirano

[11] 4,443,125

[45] Apr. 17, 1984

[54] PRINTER

[75] Inventor: Seiichi Hirano, Shiojiri, Japan

[73] Assignees: Epson Corporation, Nagano; Kabushiki Kaisha Suwa Seikosha, Tokyo, both of Japan

[21] Appl. No.: 334,398

[22] Filed: Dec. 24, 1981

[30] Foreign Application Priority Data

| | | | |
|---|---|---|---|
| Dec. 27, 1980 | [JP] | Japan | 55-188441 |
| Dec. 30, 1980 | [JP] | Japan | 55-188170 |
| Sep. 30, 1981 | [JP] | Japan | 56-155206 |

[51] Int. Cl.[3] ..... B41J 3/20; B41J 19/14; B41J 9/20

[52] U.S. Cl. ..... 400/328; 400/120; 400/611; 101/93.15; 192/51; 192/26; 192/41 S

[58] Field of Search ..... 400/120, 320, 328, 569, 400/611; 192/26, 41 S, 48.92, 51; 101/93.15

[56] References Cited

U.S. PATENT DOCUMENTS

| | | | |
|---|---|---|---|
| 2,298,970 | 10/1942 | Russell et al. | 192/26 |
| 2,894,403 | 7/1959 | Tomko | 192/41 S |
| 3,064,766 | 11/1962 | Hanizesk | 192/41 S |
| 3,225,886 | 12/1965 | Certran et al. | 400/328 |
| 3,304,793 | 2/1967 | Nishimura | 192/51 |
| 3,835,976 | 9/1974 | Behrens et al. | 400/320 |
| 3,845,850 | 11/1974 | Herr et al. | 400/120 |
| 3,848,720 | 11/1974 | Carlsen | 400/120 |
| 3,934,698 | 1/1976 | McGourty | 400/120 |
| 4,040,511 | 8/1977 | Beaven, Jr. et al. | 400/120 |
| 4,167,345 | 9/1979 | Englund et al. | 400/320 |

OTHER PUBLICATIONS

Klein et al, "Electromechanical . . . System", IBM Technical Disclosure Bulletin, vol. 17, No. 4, pp. 959-960. 9/74.

Overton, "Modular Increment Clutch", IBM Technical Disclosure Bulletin, vol. 21, No. 2, pp. 471-472.

*Primary Examiner*—William Pieprz

*Attorney, Agent, or Firm*—Blum, Kaplan, Friedman, Silberman & Becan

[57] ABSTRACT

A printer having a printing head which prints characters across lines on a recording medium. The printer includes a frame having a driving shaft rotatably supported thereon and a motor for rotating the driving shaft in first and second directions. The printer also includes a paper feeding mechanism and a platen releasing mechanism. A clutch mechanism is driven by the driving shaft and is operatively coupled to the paper feeding and platen releasing mechanisms for selective operation thereof.

6 Claims, 11 Drawing Figures

FIG. 5
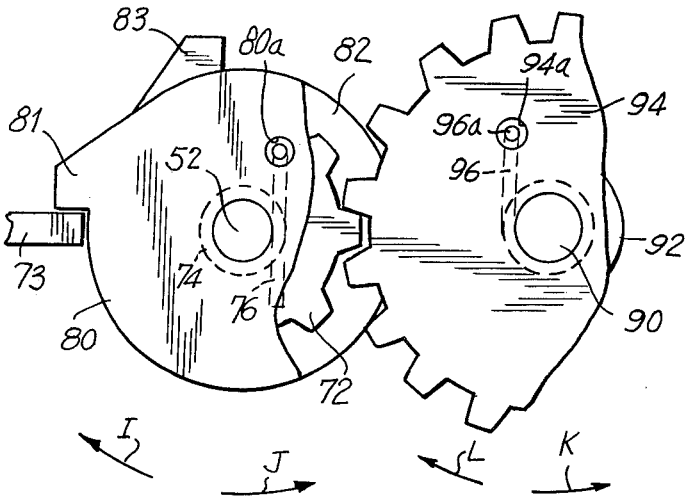
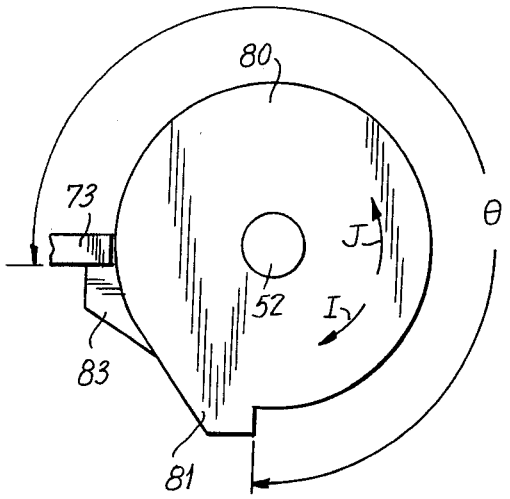
FIG. 6

PRINTER

BACKGROUND OF THE INVENTION

This invention is directed to a printer and, in particular, to a small-sized serial type thermal printer in which a thermal printing head is laterally driven across a thermosensitive recording medium to carry out printing.

In conventional serial-type thermal printers, printing of characters is performed by serially pressing a thermal printing head to a thermosensitive recording medium or paper against a platen and then actuating the printing head. In such printers, the pressure of the thermal printing head against the platen must be relaxed in order to allow for advancement of the thermosensitive paper past the printing head and to allow for lateral translation of the thermal printing head across the thermosensitive paper. Therefore, printers have been constructed as full cycle machines wherein the printing head is required to move laterally across the full width of the paper before return is possible. For example, a rotatable cylinder having a helical drive surface has been provided for reciprocating the printing head across the paper as described in U.S. Pat. No. 3,986,594. Another type of full cycle mechanism is described in U.S. Pat. No. 4,250,808.

However, such printers have the following disadvantages: (1) since the printing mechanisms are full cycle machines, even if a few characters are to be printed along one line, the printing head must traverse the entire width of the printing medium before returning to a reset position; (2) it is difficult to increase the speed of operation since the printing head must fully traverse the recording medium; (3) electrical power is wastefully consumed; (4) the useful life of the printing head is shortened due to excess abrasion against the printing paper and the platen; and (5) printing paper feeding at high speed is not possible.

Prior printer constructions which attempted to provide for return of the printing head to the reset position from any printing position require additional power sources or intricate mechanisms for paper feeding and platen releasing. This prevents both miniaturization of a printer and reduction in the manufacturing costs.

Attempts have been made to mechanically couple the paper feeding mechanism in a printer to the main driving shaft which causes the printing head to move across the recording paper. Such prior constructions are noisy in operation since a toothed lever connected to the paper feeding roller in the paper feeding mechanism crashes against a toothed wheel coupled to the main driving shaft. In addition, since it has proven difficult to obtain a given amount of rotation in either direction on the same axis as the main driving shaft which itself can rotate by any amount in either direction, the miniaturization of a printer is difficult.

Accordingly, a small-sized serial-type printer in which the printing head drive mechanism, paper feeding mechanism and platen releasing mechanism are operatively coupled and which has a simplified construction and is relatively inexpensive to manufacture, is desired.

SUMMARY OF THE INVENTION

Generally speaking, in accordance with the present invention, a serial printer construction especially adapted for use as a serial-type thermal printer is provided. The printer includes a printing head which prints characters across lines on a recording medium. A driving shaft in the printer is rotatably supported on a frame and is adapted to rotate in first and second directions for reciprocatingly moving the printing head across the recording medium. A clutch mechanism is driven by the driving shaft for a predetermined amount of rotation therewith. The clutch mechanism is operatively engaged with a paper feeding mechanism and selectively operates the paper feeding mechanism for selectively advancing the recording medium past the printing head. A platen mechanism is also operatively engaged with the clutch mechanism so that when operated, the platen mechanism selectively presses the recording medium against the printing head.

The clutch mechanism includes a toothed wheel freely rotatable on the driving shaft. First and second torsional coil springs are mounted on the driving shaft on both sides of the toothed wheel, respectively, one end of each coil spring being secured to the toothed wheel. A first and second ratchet wheel is freely rotatably mounted on the driving shaft proximate each coil spring, respectively. The opposite end of each coil spring is respectively coupled to the first and second ratchet wheels. The coil springs cause the toothed wheel to rotate with the driving shaft until one of the ratchet wheels contacts a stationary surface on the frame which in turn causes the respective coil spring to loosen thereby freeing the toothed wheel and ratchet wheels from rotation with the driving shaft.

Accordingly, it is an object of the present invention to provide a small-sized serial-type printer.

Another object of the invention is to provide a thermal printer in which printing is carried out at a high speed.

A further object of the invention is to provide a thermal printer in which consumption of electric power is decreased.

Still a further object of the invention is to provide a thermal printer in which paper feeding at a high speed is possible.

Yet another object of the invention is to provide a small-sized thermal printer which is relatively inexpensive to manufacture.

Still another object of the invention is to provide a serial printer which is relatively quiet in operation.

Another object of the invention is to provide a paper feeding mechanism for a printer which operates quietly yet which is small-sized.

Yet another object of the invention is to provide a paper feeding mechanism which can utilize a simple one-way clutch to operate.

A still further object of the invention is to provide a small-sized and simply constructed reciprocating rotation apparatus.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 5 and 6 are side elevational views depicting the construction and principles of operation of the reciprocating rotation apparatus depicted in FIG. 4 and constructed in accordance with the present invention;

DESCRIPTION OF THE PREFERRED EMBODIMENTS

Figure 1:
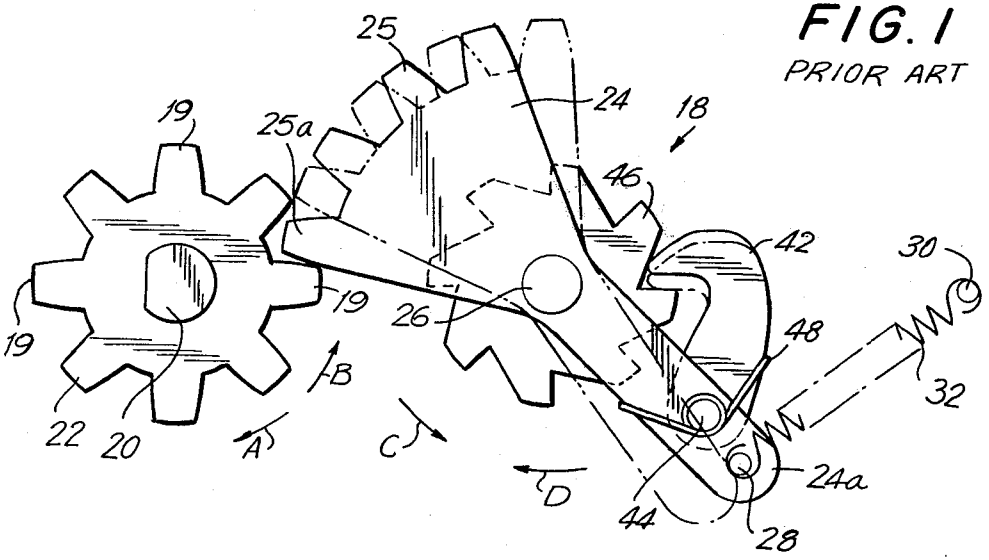
FIG. 1 PRIOR ART
FIGS. 1 and 2 are diagrams depicting the construction and principles of operation of a conventional reciprocating rotation device in accordance with the prior art.
Figure 2:
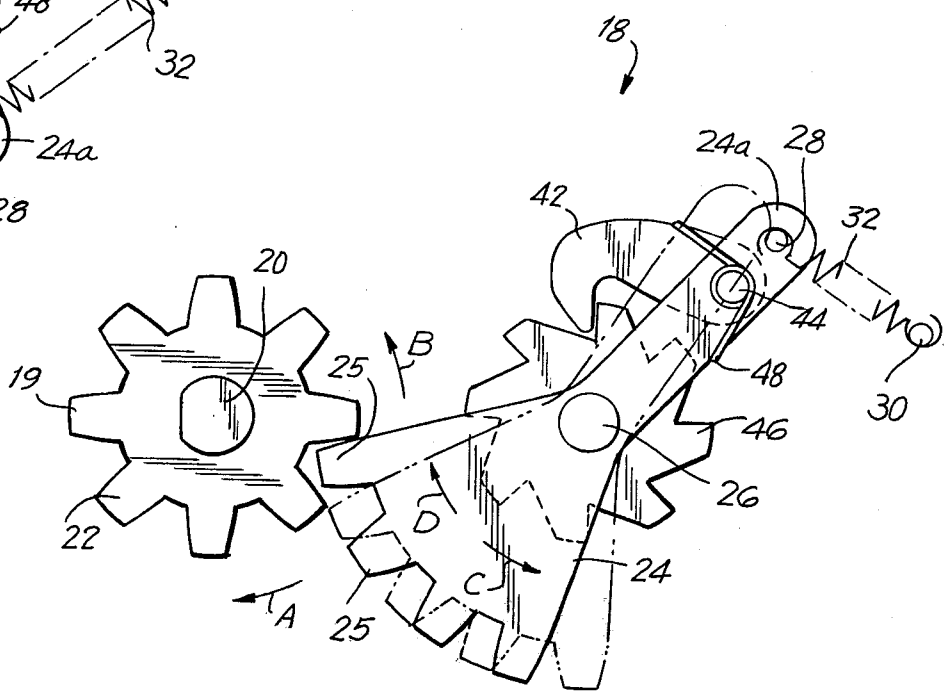
FIG. 2 PRIOR ART
Figure 3:
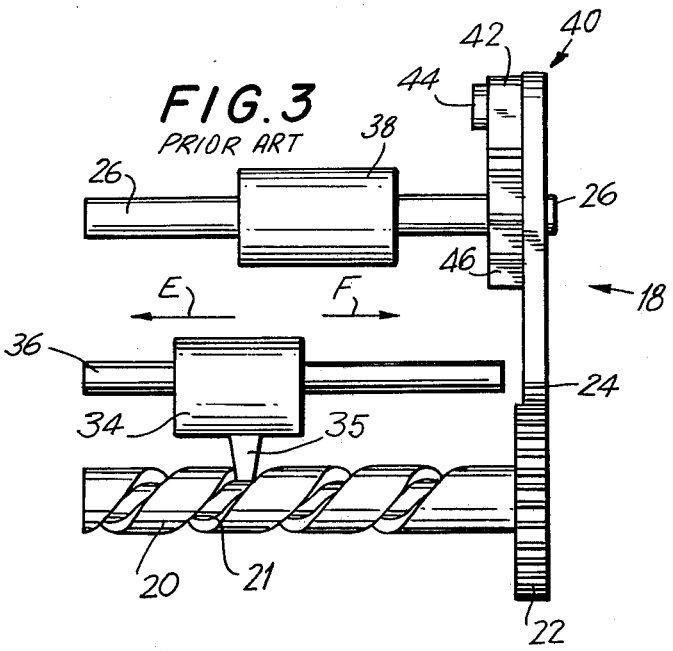
FIG. 3 PRIOR ART
FIG. 3 is a top plan view depicting the construction of a conventional printer incorporating the reciprocating rotation apparatus depicted in FIGS. 1 and 2.

Referring first to FIGS. 1 through 3, a conventional reciprocating rotation (rotation to rotation) apparatus, generally indicated at 18, utilized in a conventional printer, generally indicated at 40, for feeding a recording medium through the printer, will be described. A driving shaft 20 is rotatable in either (clockwise or counterclockwise) direction. A toothed or driving wheel 22 is fixed on shaft 20 so as to rotate therewith. A fan-shaped sector lever 24 is freely rotatably coupled on a second shaft 26 spaced from driving shaft 20 so that teeth 25 on sector lever 24 are engagable with teeth 19 on toothed wheel 22. End 24*a* of sector lever 24 opposite teeth 25 includes a spring pin 28 and a second spring pin 30 is provided on the frame (not shown) of the printer. A spring 32 is coupled intermediate pin 28 on sector lever 24 and pin 30 on the printer frame.

As depicted in FIG. 1, the force exerted by spring 32 on sector lever 24 causes first tooth 25*a* thereon to engage with toothed wheel 22. When driving shaft 20 is rotated in the direction of arrow A, sector lever 24 is moved in the direction of arrow C by toothed wheel 22. As sector lever 24 continues its movement in the direction of arrow C, the force exerted by spring 32 on sector lever 24 will reverse as depicted in FIG. 2 so that sector lever 24 is then urged in the direction of arrow D.

When driving shaft 20 reverses direction and rotates in the direction of arrow B, sector lever 24 will be rotated in the direction of arrow D until raised to the position depicted in FIG. 1. Such reciprocating actuation is repeated to obtain any amount of reciprocating rotation of sector lever 24.

The above described construction and operation has the following disadvantages. First, toothed wheel 22 crashes against sector lever 24 as toothed wheel 22 continues rotating in the direction of arrow B as depicted in phantom in FIG. 1 after sector lever 24 has reached its upper position as depicted in FIG. 1. Similarly, the same crashing occurs when sector lever is in its lower position as depicted in FIG. 2 and toothed wheel 22 continues rotating in the direction of arrow A as depicted in FIG. 2. This causes the device to produce a loud noise. Second, since it is impossible with such a device to obtain any given amount of reciprocating rotation on the same axis as driving shaft 20 which itself reciprocatingly rotates in both directions, the miniaturization of an apparatus incorporating such a device is difficult.

A helical camming surface or groove 21 is provided in driving shaft 20 as depicted in FIG. 3. A printing head 34 in printer 40 is slidably supported on a shaft 36. Printing head 34 includes a projection 35 which rides in helical groove 21. Shaft 26 on which sector lever 24 is rotatably mounted includes a paper feeding roller 38 so that shaft 26 acts as the paper feeding shaft in printer 40. A pawl 42 is pivotably supported on a shaft 44 secured to end 24*a* of sector lever 24. Pawl 42 is engaged against a ratchet wheel 46 secured to paper feeding shaft 26 so as to rotate therewith. A clamping spring 48 is coupled intermediate pawl 42 and end 24*a* of sector lever 24 so that pawl 42 is always engaged with ratchet wheel 46.

When driving shaft 20 rotates in the direction of arrow A, printing head 34 will move laterally across a recording paper in the direction of arrow E to print a line of characters thereacross since projection 35 on head 34 is engaged in helical groove 21 on driving shaft 20. At the same time, sector lever 24 will be moved downward in the direction of arrow C by the meshing engagement thereof with toothed wheel 22. When the desired printing is finished, driving shaft 20 will change rotation directions and rotate in the direction of arrow B and printing head 34 will begin to traverse the recording paper in the opposite direction indicated by arrow F. Since spring 32 will exert a downward force on end 24*a* of sector lever 24 as depicted in FIG. 2, sector lever 24 will be urged in the direction of arrow D. Sector lever 24 will return to the position depicted in FIG. 1 and will crash against toothed wheel 22 as toothed wheel 22 continues rotating in the direction of arrow B as indicated in phantom in FIG. 1. As sector lever 24 moves between the position depicted in FIG. 1 and the position depicted in phantom in FIG. 1, pawl 42 will cause ratchet wheel 46 to rotate in the direction of arrow D thereby rotating paper feeding shaft 26 and hence roller 38 secured thereon.

As driving shaft 20 continues rotating in the direction of arrow B, sector lever 24 is continued to be intermittently pressed in the direction of arrow D by toothed wheel 22 and in the direction of arrow C by the force exerted thereon by spring 32. When driving shaft 20 continues rotating in the direction of arrow B and print head 34 moves in the direction of arrow F to return to the reset position, driving shaft 20 will change rotation directions and begin to rotate in the direction of arrow A. Print head 34 will again begin to move in the direction of arrow E to start printing when moved into the printing start position, and the operation described above is repeated. In addition to the noise caused by the crashing engagement of sector lever 24 with toothed wheel 22, when the reciprocating rotation of sector lever 24 is converted to any amount of rotation in one direction by swinging at both ends, it is necessary to use a one-way clutch having a large play and a lot of parts. For example, the pawl and ratchet wheel combination depicted in FIGS. 1 and 2 is required. In such a construction, it is not possible to use a simple one-way clutch having a small play, for example, a spring clutch or a roller clutch. As aforenoted, since it is practically impossible to obtain a desired amount of rotation in either direction on the same axis as the axis of driving shaft 20 which performs any amount of rotation in both directions, the miniaturization of a device incorporating such a mechanism is difficult since such rotation cannot be performed on the same shaft or axis.

Figure 4:
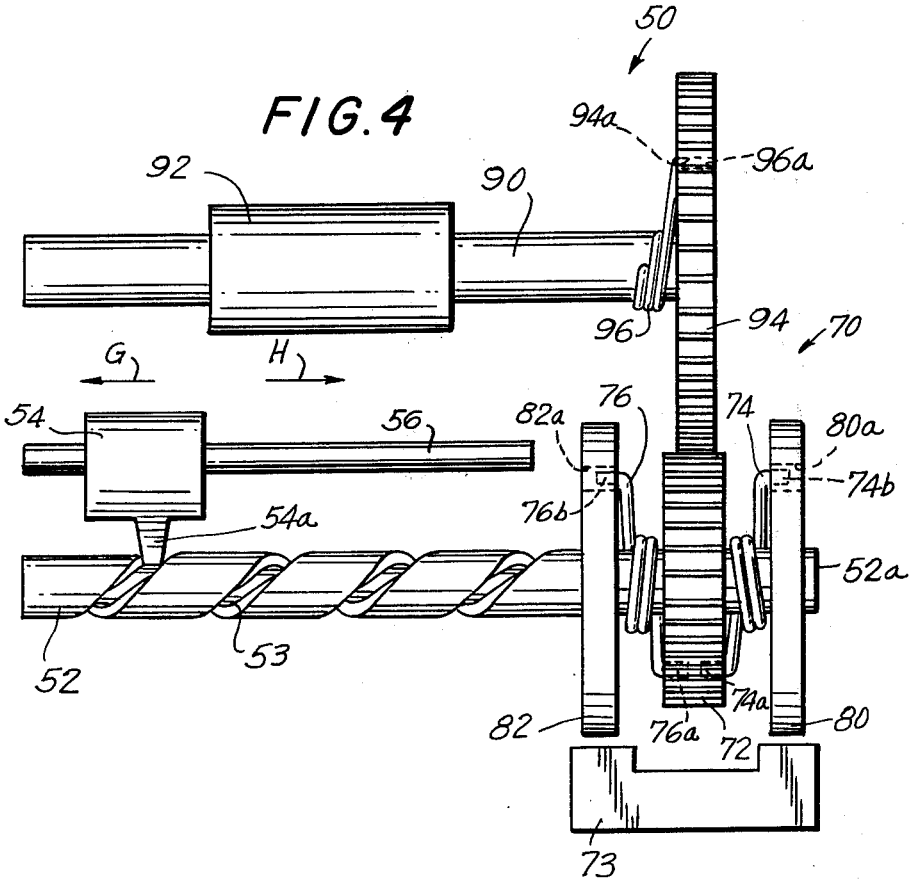
FIG. 4 is a top plan view depicting the construction of a printer constructed in accordance with the present invention and incorporating a reciprocating rotation apparatus according to the present invention.

Referring now to FIGS. 4 through 6, the construction and operation of a printer, generally indicated at 50, incorporating a reciprocating rotation mechanism, generally indicated at 70 and constructed in accordance with the present invention will be described. Referring specifically to FIG. 4, printer 50 includes a main driving shaft 52 having a helical camming surface or groove 53 formed therein. Driving shaft 52 is rotatable by a motor (not shown) in both directions (clockwise and counterclockwise) by any amount depending upon the number of characters to be printed across a printing medium. A printing head 54 is slidably supported on guide shaft 56 mounted in printer 50.

A toothed following or driven wheel 72 is rotatably supported on driving shaft 52 so as to be freely rotatable with respect thereto. A torsional coil spring 74 and a torsional coil spring 76 are provided on each side, respectively, of following wheel 72. Coil springs 74 and 76 have an inner diameter which is slightly less than the outer diameter of driving shaft 52 so that coil springs 74 and 76 fit relatively tightly on driving shaft 52. End 74*a* and end 76*a* of coil springs 74 and 76, respectively, are engaged with following wheel 72. A ratchet wheel 80 is rotatably coupled to shaft 52 proximate end 52*a* thereof and includes a slot 80*a* which receives second end 74*b* of spring 74. Similarly, a second ratchet wheel 82 is rotatably coupled on driving shaft 52 proximate second coil spring 76 and includes a slot 82*a* in which second end 76*b* of coil spring 76 is inserted. Following wheel 72, ratchet wheels 80 and 82, and coil springs 74 and 76 define the clutch drive mechanism in the printer.

A paper feeding shaft 90 is rotatably supported on printer 50 and includes a paper feeding roller 92 secured thereon so as to rotate therewith. A toothed paper feeding wheel 94 is rotatably coupled to paper feeding shaft 90. Wheel 94 is meshingly engaged with following wheel 72. A torsional coil spring 96 is relatively tightly secured on paper feeding shaft 90. A first end 96*a* is engaged in a slot 94*a* on paper feeding wheel 94. As described below, coil spring 96 operates as a one-way clutch mechanism for rotating paper feeding shaft 90.

Referring to FIGS. 5 and 6 in addition to FIG. 4, when driving shaft 52 is rotated in the direction of arrow J against the load of following wheel 72, coil spring 74 will tighten and the frictional force between the inner periphery of coil spring 74 and the outer periphery of driving shaft 52 will increase. Thus, the torque exerted by driving shaft 52 in the direction indicated by arrow J will be transmitted to following wheel 72 through coil spring 74. When driving shaft 52 rotates in the direction of arrow I, coil spring 72 will loosen and the frictional force between coil spring 72 and driving shaft 52 will decrease. Thus, the torque exerted by driving shaft 52 will not be transmitted to following wheel 72 through coil spring 74.

A stopper member 73 is also provided on the frame of printer 50. Ratchet wheel 80 includes a pawl 81 which engages against stopper 73 when in the position depicted in FIG. 5. Ratchet wheel 82 includes a pawl 83 which engages on the underside of stopper member 73 when in the position depicted in FIG. 6.

When driving shaft 52 rotates in the direction of arrow J and the torque exerted thereby in the direction indicated by arrow J is transmitted to following wheel 72 through coil spring 74, when camming surface 81 engages against stopper 73, coil spring 74 will loosen, the frictional force between coil spring 74 and driving shaft 52 will be reduced and following wheel 72 will stop rotating since torque is not transmitted thereto by driving shaft 52. However, since coil spring 76 is secured on shaft 52, torque will be transmitted to following wheel 72 through coil spring 76 only when driving shaft 52 is rotated in the direction of arrow I and camming surface 83 on ratchet wheel 82 is not engaged with stopper 73. Coil spring 96 is inserted on paper feeding shaft 90 so as to transmit torque exerted thereon by paper feeding wheel 94 only when wheel 94 is rotated in the direction of arrow L.

In the state of printing, driving shaft 52 rotates in the direction of arrow I and print head 54 will move along a recording medium in the direction of arrow G to print a line of characters. When the desired printing is finished, driving shaft 52 will change direction of rotation and will begin to rotate in the direction of arrow J and print head 54 will move in the reverse direction in the direction of arrow H. In the state where printing is finished, pawl 83 on ratchet wheel 82 will be pressing against stopper 73 as depicted in FIG. 6 and coil spring 76 will be loosened so that following wheel 72 and ratchet wheels 80 and 82 will be stopped. When driving shaft 52 then begins to rotate in the direction of arrow J, the frictional force between driving shaft 52 and coil spring 74 will increase, the torque exerted by driving shaft 52 will be transmitted through coil spring 74 to following wheel 72, and following wheel 72 and ratchet wheels 80 and 82 will rotate in the direction of arrow J.

As depicted in FIG. 6, following wheel 72 and ratchet wheels 80 and 82 will rotate through an angle $\theta$, pawl 81 will press against stopper member 73 (FIG. 5), coil spring 74 will loosen and following wheel 72 and ratchet wheels 80 and 82 will stop due to the reduction in frictional force between driving shaft 52 and coil spring 74. While following wheel 72 rotates through angle $\theta$ in the direction of arrow J, paper feeding gear 94 which is always engaged with following wheel 72 rotates in the direction of arrow L, the torque in the direction indicated by arrow L is transmitted to paper feeding shaft 90 due to the increase in frictional force between coil spring 96 and paper feeding shaft 90, and paper feeding shaft 90 and paper feeding roller 92 thereon rotate in the direction of arrow L by a given amount to feed a recording paper through the printer past printing head 54. If driving shaft 52 continues to rotate in the direction of arrow J, following wheel 72 and ratchet wheels 80 and 82 remain stopped in the state as shown in FIG. 5 since pawl 81 on ratchet wheel 80 presses against stopper 73 to loosen coil spring 74.

When printing head 54 moves in the direction of arrow H to return to the waiting or reset position, driving shaft 52 will change rotation direction and begin rotating in the direction of arrow I. Printing head 54 will begin to move in the direction of arrow G to start printing the next line of characters when in the printing region. When driving shaft 52 begins to rotate in the direction of arrow I, the frictional force between driving shaft 52 and coil spring 76 increases, the torque of driving shaft 52 is transmitted to following wheel 72, following wheel 72 and ratchet wheels 80 and 82 will rotate through angle $\theta$ in the direction of arrow I, pawl 83 on ratchet wheel 82 will move against the underside of stopper 73 to stop the motion, and following wheel 72 and ratchet wheels 80 and 82 will stop in the position shown in FIG. 6.

At this time, although paper feeding gear 94 rotates in the direction of arrow K by a given amount, the torque exerted thereon by following wheel 72 is not transmitted to paper feeding shaft 90 and paper feeding roller 92 since coil spring 96 is loosened. Further, when driving shaft 52 rotates in the direction of arrow I and print head 54 finishes the desired printing, driving shaft 52 changes rotation direction again and the series of steps described above are repeated for printing consecutive lines and feeding the paper. In the case where coil springs 74, 76 and 96 are loosened, the torque (loose torque), is slight. In coil springs 74 and 76, the torque is a force to engage pawls 81 and 83 on ratchet wheels 80 and 82, respectively, with stopper member 73. However, the torque of coil spring 96 is not large enough to operate paper feeding shaft 90 or roller 92.

According to the construction described above, as following wheel 72 is only rotated during a portion of the rotation of driving shaft 52 due to the engagement of pawl 81 on ratchet wheel 80 or pawl 83 on ratchet wheel 82 with stopper 73, there is no swing at either end of the rotation process. It is therefore possible to provide a paper feeding device which has no crash as in conventional paper feeding devices described above which utilize a reciprocating rotation apparatus which generates loud noise, and a clutch in which a small amount of play is presented can be utilized. As any amount of reciprocating rotation is provided to following wheel 72 on the same axis as driving shaft 52 which rotates by any amount in both directions, it is possible to miniaturize a printing apparatus in which such a construction is utilized. That is, unlike conventional devices wherein the toothed wheel on the driving shaft continues to rotate together with the driving shaft, the following wheel in the present invention on the driving shaft does not rotate the whole time that driving shaft 52 is rotated but rather only reciprocatingly rotates through the angle $\theta$.

Figure 7:
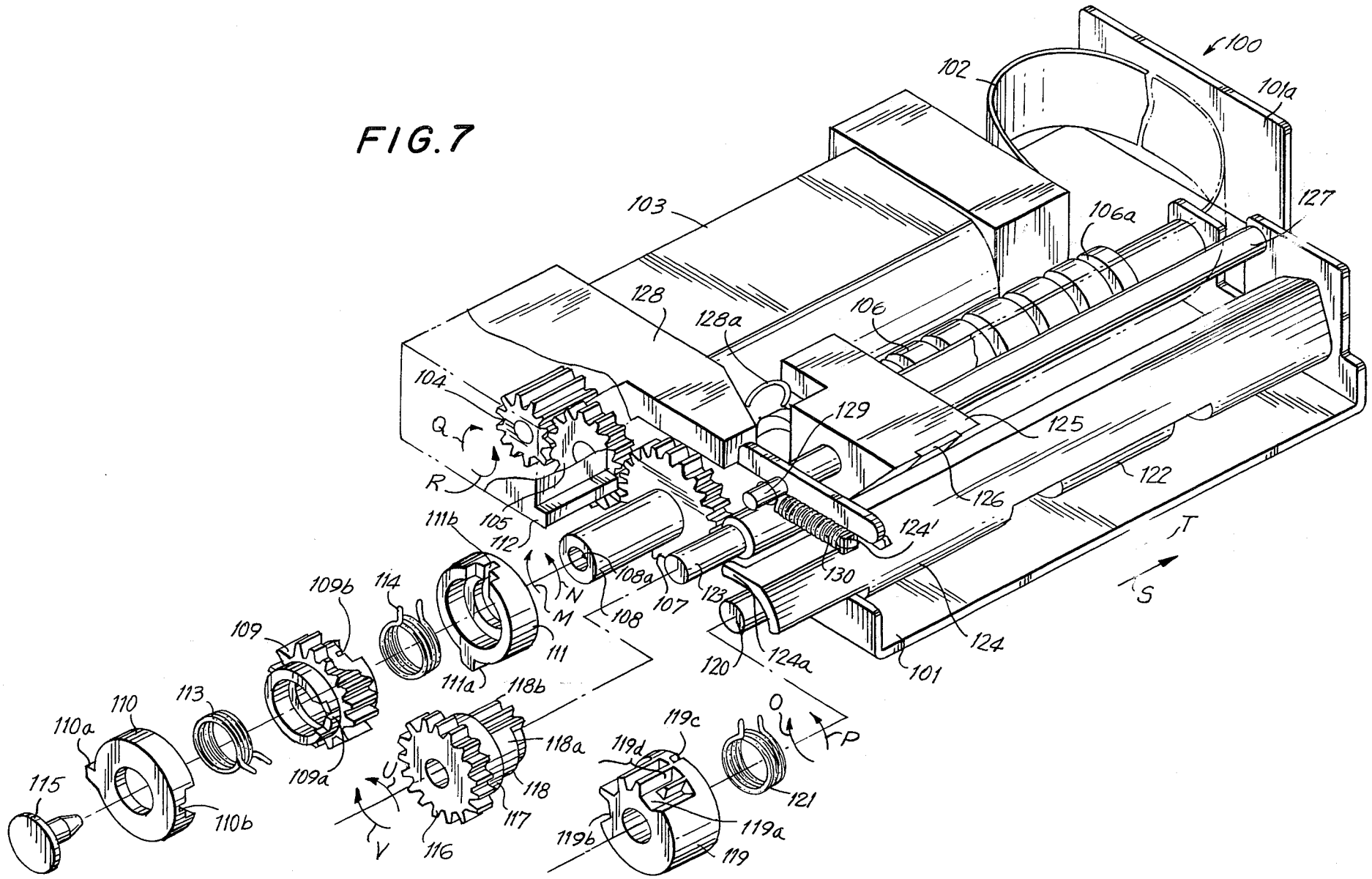
FIG. 7 is an exploded perspective view of a thermal printer constructed in accordance with the present invention.

Reference is now made to FIG. 7 which depicts the construction of a thermal printer, generally indicated at 100, and constructed in accordance with the present invention utilizing the reciprocating rotation apparatus described above. Printer 100 includes a frame 101 having a guide portion 101*a* for guiding a flexible printed circuit 102. A motor 103 is secured on frame 101 and includes a motor gear 104 fixed on the drive shaft of motor 103. Motor gear 104 is meshingly engaged with an intermediate gear 105 rotatably supported on frame 101. A driving shaft 108 rotatably mounted on frame 101 includes a cylindrical driving cam cylinder 106 which includes a helical groove or camming surface 106*a*. A gear 107 is fixed to driving shaft 108 and is meshingly engaged with gear 105. A toothed clutch gear following wheel 109 is freely rotatably supported on driving shaft 108. Clutch ratchet wheels 110 and 111 are also freely rotatably supported on driving shaft 108 on each side, respectively, of clutch gear 109. Clutch ratchet wheel 111 includes a pawl 111*a* and clutch ratchet wheel 110 includes a pawl 110*a* which engage against a stopper member 112 on frame 101 as described below. A torsional coil spring 113 has an inside circumference which is slightly smaller than the outside circumference of driving shaft 108 and is placed on driving shaft 108 by pressure. One end of coil spring 113 is fixed in a groove 109*a* in clutch gear 109 and the other end of coil spring 113 is fixed in a groove 110*b* in clutch ratchet wheel 110. Driving shaft 108, clutch gear 109, clutch ratchet wheel 110 and coil spring 113 comprise in part, the spring clutch drive mechanism of the printer.

When driving shaft 108 is rotated in the direction of arrow M, since coil spring 113 is tightened, torque in the direction of arrow M is transmitted through coil spring 113 to clutch gear 109 which has a load for rotation and clutch gear 109 is rotated in the direction of arrow M. However, when clutch ratchet wheel 110 is stopped by the engagement of pawl 110*a* with the underside of stopper member 112 (FIG. 10), coil spring 113 will loosen and torque will not be transmitted to clutch gear 109. When driving shaft 108 is continued to be rotated in the direction of arrow M, since the inside circumference of coil spring 113 is increased so that only a very slight torque which is less than the load for rotation of clutch gear 109 is transmitted to clutch gear 109, clutch gear 109 will not rotate.

A second coil spring 114 similar to spring 113 is placed on driving shaft 108 by pressure. One end of coil spring 114 is engaged in a slot 109*b* in clutch gear 109 and the other end of coil spring 114 is engaged in a slot 111*b* in ratchet wheel 111. Only when driving shaft 108 is rotated in the direction of arrow N and clutch ratchet wheel 111 is not stopped by engagement with stopper 112, the torque in the direction of arrow N will be transmitted to clutch gear 109 by coil spring 114 so that clutch gear 109 rotates in the direction of arrow N. Clutch gear 109, ratchet wheels 110 and 111 and coil springs 113 and 114 together comprise the clutch drive mechanism in printer 100.

Clutch ratchet wheel 110 and clutch ratchet wheel 111 are arranged as follows: (1) when pawl 110*a* is stopped by engagement with stopper 112 (FIG. 10), pawl 111*a* of ratchet wheel 111 does not contact stopper member 112, similarly (2) when pawl 111*a* is stopped by engagement with stopper 112 (FIG. 8), pawl 110*a* on ratchet wheel 110 does not contact stopper member 112. A fixing pin 115 is inserted in an opening 108*a* in the end of driving shaft 108 and holds clutch ratchet wheels 110 and 111 on of driving shaft 108.

An operation gear 116 is rotatably coupled on a shaft 123 on printer frame 101 and is meshingly engaged with clutch gear 109 that it may rotate at a reduced speed or the same speed as that of the rotation of clutch gear 109. Operation gear 116 is unitarily formed with a platen release cam 117 and an intermittent gear 118 for feeding paper as described below.

A paper feeding gear 119 is engaged with intermittent gear 118 and includes locking portions 119*a* and 119*b* which can be locked to a locking portion 118*a* on intermittent gear 118. Paper feeding gear 119 is rotatably coupled on a paper feeding roller shaft 120 which includes a paper feeding roller 122 secured thereon, which is rotatably supported on frame 101. A coil spring 121 has an inside circumference which is slightly smaller than the outside circumference of paper feeding roller shaft 120. Coil spring 121 is placed on paper feeding roller shaft 120 by pressure. A first end of spring 119 is held in a groove 119*c* in paper feeding gear 119 and acts as a one-way clutch. Accordingly, even if paper feeding gear 119 is rotated reciprocatingly (in either direction), only when paper feeding gear 119 rotates in the direction of arrow 0 will paper feeding roller shaft 120, to which a load for paper feeding is placed, rotate in the direction of arrow 0.

A platen 124 is rotatably coupled to paper feeding roller shaft 120 and urged in the direction of arrow P by a spring 130 coupled between a pin 129 on frame 101 and a tab 124' on platen 124. In addition, platen 124 has a cam follower projection 124a which is engagable against platen release cam 117.

A carriage 125 which supports a thermal printing head 126 coupled to flexible printed circuit 102 is slideably coupled on a guide shaft 127 secured to frame 101. Carriage 125 has a projection which is engaged in helical groove 106a in driving cam cylinder 106. A detector 128 generates a signal for determining the printing start position and has a moveable terminal 128a which is engagable against carriage 125.

Figure 9:
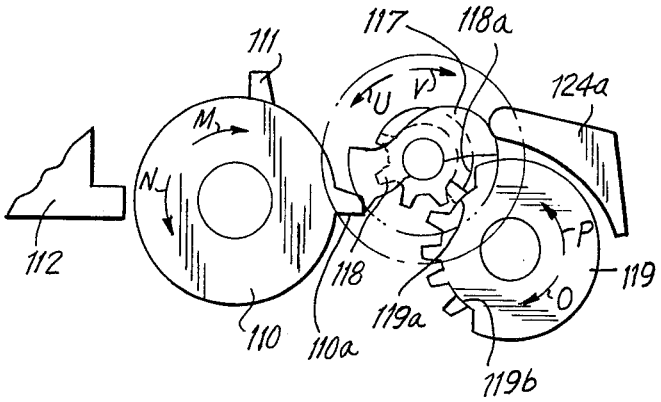
Figure 10:
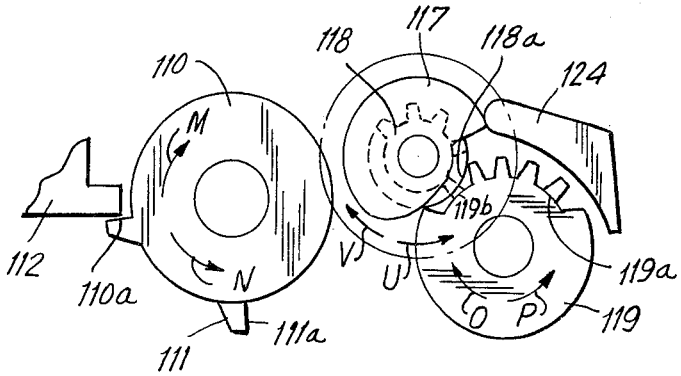
Figure 11:
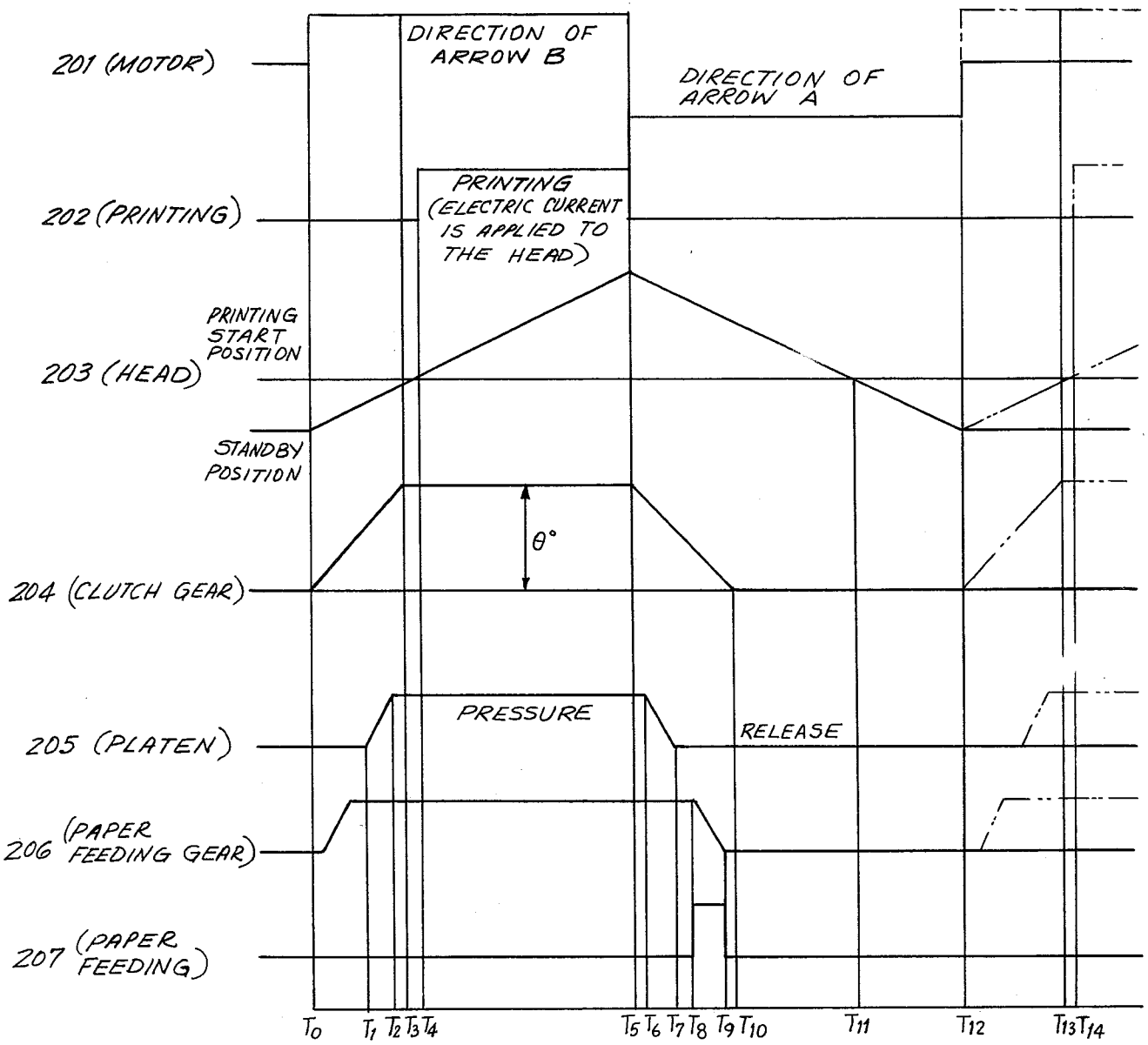
FIG. 11 is a timing chart illustrating the timing of the operation of various mechanisms in the thermal printer depicted in FIG. 7.

Referring now to FIGS. 7 through 11, the series of operations performed by thermal printer 100 will be described with specific reference to the timing chart in FIG. 11. In FIG. 11, the graph of the direction of rotation of motor 103 is indicated by 201, printing is indicated by graph 202, the operation of printing head 126 is indicated by graph 203, the operation of clutch gear 109 is indicated by 204, the operation of platen 124 is indicated by 205, the operation of paper feeding gear 119 is indicated by graph 206, and the operation of paper feeding by paper feeding roller 122 is indicated by 207. In the timing chart of FIG. 11, a full line indicates one-line printing and a dotted line indicates continuous printing.

I. Standby Position ($T_0$, $T_{12}$)

The standby state is at the points of time $T_0$ and $T_{12}$ depicted in FIG. 11. In the standby state, carriage 125 and head 126 supported thereon are at the standby position at the time when driving cam cylinder 106 rotates more than 360° in the direction of arrow M from the printing start position determined by detector 128. This rotation is greater than angle $\theta$ from the state depicted in FIG. 8 to that depicted in FIG. 10 in the direction of arrow M. Clutch ratchet wheels 110 and 111, platen release cam 117, intermittent gear 118, paper feeding gear 119 and platen cam follower 124a are in the position depicted in FIG. 10. At this time, pawl 110a on clutch ratchet wheel 110 contacts stopper member 112 and clutch ratchet 110 is thereby stopped from rotating by the engagement. The pressure of platen 124 against printing head 126 is released by the platen release cam 118 and paper feeding gear 119 is locked by intermittent gear 118 at the locked portion 119b.

II. Preparation for Printing ($T_0$–$T_4$)

When motor 103 beging rotating in the direction of arrow of R at $T_0$, driving cam cylinder 106, gear 107 and driving shaft 108 receive torque in the direction of arrow N through intermediate gear 105 and rotate. At that time, carriage 125 and printing head 126 are moved in the direction of arrow S along guide shaft 127 by head driving cam cylinder 106 and reach the printing start position at $T_4$.

Figure 8:
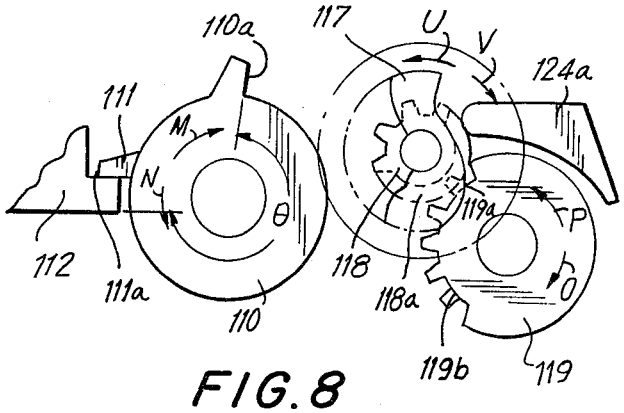
FIGS. 8, 9 and 10 are side elevational views of the printer depicted in FIG. 7 for explaining the principles of operation of the paper feeding and platen release mechanisms.

Since coil spring 114 becomes tightened by this action, clutch gear 109 receives torque in the direction of arrow N through coil spring 114 and rotates through angle $\theta$ in the direction of arrow N together with clutch ratchet wheels 110 and 111 from the position depicted in FIG. 10 to the position in which pawl 111a on clutch ratchet wheel 111 comes into contact with stopper member 112 (FIG. 8). Clutch ratchet wheel 111 is stopped and coil spring 114 is loosened. Thereafter, clutch gear 109 stops in the position depicted in FIG. 8 at $T_3$. When clutch gear 109 begins to rotate in the direction of arrow N at $T_0$, platen release cam 117 and intermittent gear 118 which are formed unitarily with operation gear 116 engaged with clutch gear 109 starts to rotate in the direction of arrow V at the same time. A short time after $T_0$, engaging portion 118b of intermittent gear 118 is engaged with engaging portion 119a of paper feeding gear 119 and paper feeding gear 119 rotates in the direction of arrow P as depicted in graph 206 in FIG. 11. However, since the inside circumference of coil spring 121 is increased, paper feeding roller shaft 120 and paper feeding roller 122 do not rotate.

When clutch gear 109 is further rotated, the engagement of intermittent gear 118 and paper feeding gear 119 ends and the locked portion 119a of paper feeding gear 119 is engaged with locking portion 118a on intermittent gear 118 and locked as depicted in FIG. 8. Between $T_0$ and $T_1$, platen 124 is not pressed against printing head 126. Thereafter, at $T_1$, cam follower 124a on platen 124 contacts against a larger radius portion of platen release cam 117, and rotates in the direction of arrow P until $T_2$ when platen 124 is pressed against printing head 126, as indicated by graph 205 in FIG. 11. Finally, at $T_3$, the position of the elements is as shown in FIG. 8 and preparation for printing is completed.

III. Printing ($T_4$–$T_5$)

At $T_4$, when printing head 126 reaches the printing start position which is determined by detector 128, electric current is applied to the printing head so that the desired printing is carried out. When the printing in the desired number of positions along a printing tape is completed, at $T_5$ motor 103 changes its rotary direction from the direction indicated by arrow R to the direction indicated by arrow Q. During the time between $T_4$ and $T_5$, since coil springs 113 and 114 are loosened, the gear train following clutch gear 109 does not rotate and the state of pressing platen 124 to head 126 is retained.

IV. Platen Release and Paper Feeding ($T_5$–$T_{10}$)

At $T_5$, when motor 103 starts to rotate in the direction of arrow Q, head driving cam cylinder 106 and driving shaft 108 start to rotate in the direction of arrow M through intermediate gear 105 and gear 107 and head 126 begins to return in the direction of arrow T. When driving shaft 108 rotates in the direction of arrow M, since coil spring 113 is tightened, clutch gear 109 receives the torque in the direction of arrow M through coil spring 113 and rotates by angle $\theta$ in the direction of arrow M. Clutch ratchet wheels 110 and 111 rotate from the position depicted in FIG. 8 until pawl 110a on clutch ratchet wheel 110 is brought into contact with stopper 112 as depicted in FIG. 10 and coil spring 113 is loosened so that clutch ratchet wheel 110 is stopped from rotating, and stops at $T_{10}$ as depicted in FIG. 11.

Platen release cam 117 and intermittent gear 118 which are formed unitarily with operation gear 116 engaged with clutch gear 109 start to rotate in the direction of arrow U simultaneously with the start of the rotation of clutch gear 109 in the direction of arrow M at $T_5$. At $T_6$, cam follower 124a on platen 124 contacts the radius changing portion of platen release cam 117 and platen 124 rotates in the direction of arrow 0 along the cam lead of platen release cam 117 as indicated by graph 205 in the timing chart depicted in FIG. 11 in opposition to the urging force of spring member 130.

At $T_7$, cam follower 124a of platen 124 reaches the long radius portion of platen release cam 117 and the operation of platen release ends as a result of which platen 124 is released from pressing to head 126 and kept released even if platen release cam 117 further rotates. Meanwhile, paper feeding gear 119 is kept locked because of the engagement of locked portion 119*a* on paper feeding gear 119 with locked portion 118*a* on intermittent gear 118. Moreover, clutch gear 109 rotates in the direction of arrow M and operation gear 116 on intermittent gear 118 rotates in the direction of arrow U until at $T_8$, the engaged portion 118*b* of intermittent gear 118 is engaged with the engaged portion 119*d* of paper feeding gear 119 as depicted in FIG. 9 so that paper feeding gear 119 starts to rotate in the direction of arrow 0. When paper feeding gear 119 rotates in the direction of arrow 0, the inside circumference of coil spring 121 is decreased, paper feeding roller shaft 120 and paper feeding roller 122 rotate in the direction of arrow 0 and paper feeding is started. Furthermore, intermittent gear 118 rotates in the direction of arrow U until at $T_9$, locking portion 119*a* of intermittent gear 118 is engaged with the locked portion 119*b* of paper feeding gear 119 so that paper feeding gear 119, paper feeding roller shaft 120 and paper feeding roller 122 stop and thus paper feeding is completed. Even after the end of paper feeding, clutch gear 109 rotates in the direction of arrow M until at $T_{10}$, when pawl 110*a* on clutch ratchet wheel 110 is brought into contact with stopper 112, the inside circumference of coil spring 113 is increased as the result of which the gear train following clutch gear 109 stops in the position depicted in FIG. 10.

V. Printing Head Return ($T_5$–$T_{12}$)

Prior to platen release and paper feeding, when motor 103 starts to rotate in the direction of arrow Q at $T_5$, head driving cam cylinder 106 rotates in the direction of arrow M and head 126 begins to return in the direction of arrow T. At $T_{11}$, when printing head 126 moves in the direction of arrow T and passes the printing start position as determined by detector 128, head driving cam cylinder 106 further rotates. Motor 103 stops and the return of printing head 126 ends and the course of printing of one line is completed. In the case of continuing printing, motor 103 is reversely rotated in the direction of arrow R at $T_{12}$, preparation for printing, printing, platen release, paper feeding and head return are carried out as described in II. through V. above.

VI. Quick Feeding of Paper

The standby position and preparation for quick feeding of paper are correspondingly applied to the standby position and the preparation for printing in the regular course of printing. At the standby position, motor 103 starts to rotate in the direction of arrow R and, furthermore, is kept rotating during the time that printing head 126 is moved in the direction of arrow S until it reaches the printing start position. Meanwhile, as during the preparation for printing, clutch gear 109 and clutch ratchet wheels 110 and 111 rotate through angle $\theta$ in the direction of arrow N; operation gear 116, platen release cam 117 and intermittent gear 118 rotate in the direction of arrow V, and paper feeding gear 119 rotates in the direction of arrow P to loosen coil spring 121, as a result of which the state in FIG. 10 becomes that shown in FIG. 8 and thus preparation for quick feeding of paper is completed.

When printing head 126 reaches the printing start position, motor 103 changes direction of rotation from the direction indicated by arrow Q to the direction indicated by arrow R and driving cam cylinder 106 begins to be rotated and is kept rotating in the direction of arrow M until printing head 126 moves in the direction of arrow T and reaches the standby position. Meanwhile, in the same way as platen releasing and paper feeding operations occur in the regular course of printing, clutch ratchet wheels 110 and 111 rotate by angle $\theta$ in the direction of arrow M and operation gear 116 rotates in the direction of arrow U. Platen release cam 117 rotating in the direction of arrow U, rotates platen 124 in the direction of arrow 0 in opposition to the urging force of spring member 130 and releases printing head 126 from pressing to platen 124. In addition, intermittent gear 118 rotates in the direction of arrow U and is engaged with paper feeding gear 119 during the time that the platen is released from pressing. Paper feeding gear 119 rotates in the direction of arrow 0 while tightening coil spring 121 and causes paper feeding roller shaft 120 and paper feeding roller 122 thereon to rotate in the direction of arrow 0 and thus the operation of paper feeding is complete.

In accordance with the above mentioned series of operations, paper feeding for one line ends. Such above-mentioned series of operations that causes driving cam cylinder 106 to rotate reversely at every angle of $\theta$ is repeated and quick paper feeding can be carried out.

As described above, according to the present invention, it is possible to provide a thermal printer in which such operations as the release of the platen from pressing to the printing head, paper feeding and the like are possible by incorporating the simplified construction of the reciprocating rotation device described herein even if the printing head is caused to return from any position along the thermosensitive medium. In addition, it is also possible to provide a thermal printer in which speed of printing is high, electric power is not wastefully consumed, the life of the printing head is long, quick paper feeding is possible and miniaturization in size and reduction in manufacturing costs are obtained. In addition, the printer is relatively quiet in operation and can utilize a clutch with a small amount of play.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A thermal printer having a printing head which serially prints characters across lines on a thermosensitive recording medium comprising a frame, a driving shaft rotatably supported on said frame and drive means for selectively rotating said driving shaft by any amount in first and second directions, said driving shaft being operatively coupled to said printing head to laterally reciprocate said printing head across said thermosensitive medium as said drive means rotates said driving shaft, paper feeding means supported on said frame for selectively advancing said thermosensitive medium past said printing head, a platen supported on said frame and platen release means for selectively pressing said platen to said printing head, said thermosensitive medium extending intermediate said platen and said printing head, clutch means driven by said driving shaft and operatively coupled to said paper feeding means and said platen releasing means for selectively operating said paper feeding means and said platen releasing means, said clutch means being selectively rotated in said first and second directions by a predetermined amount by said driving shaft to selectively operate said paper feeding means and said platen release means, said clutch means including a toothed wheel rotatably disposed on said driving shaft for rotation through a predetermined angle in either said first and second directions as said driving shaft rotates in one of said first and second directions, respectively, coupling means for selectively coupling said toothed wheel to said driving shaft for rotation through said predetermined angle in either said first and second directions as said driving shaft is rotated in said first and second directions, respectively, and a first ratchet rotatably disposed on said driving shaft, said coupling means including a first spring clutch having two ends disposed on said driving shaft, a first end of said spring clutch being coupled to said toothed wheel and the second end of said spring clutch being coupled to said first ratchet, said first spring clutch rotating said toothed wheel and said first ratchet through said predetermined angle in said first direction when said driving shaft is rotated in said first direction, said toothed wheel and said first ratchet not being substantially rotated in said second direction by said first spring clutch as said driving shaft is rotated in said direction, said first ratchet including a first pawl, said frame having a stopping portion which said first pawl contacts after said first ratchet moves through said predetermined angle in said first direction to stop the rotation of said first ratchet, the stopping of rotation of said first ratchet acting through said spring clutch to stop the rotation of said toothed wheel, said clutch means further including a second ratchet rotatably disposed on said driving shaft, said coupling means further including a second spring clutch having two ends disposed on said driving shaft, a first end of said second spring clutch being coupled to said toothed wheel and the second end of said second spring clutch being coupled to said second ratchet, said second spring clutch rotating said toothed wheel and said second ratchet through said predetermined angle in said second direction when said driving shaft is rotated in said second direction, said toothed wheel and said second ratchet not being substantially rotated in said first direction by said second spring clutch as said driving shaft is rotated in said first direction, said second ratchet including a second pawl, said second pawl contacting said stopping portion on said frame after said second ratchet moves through said predetermined angle in said second direction to stop the rotation of said second ratchet, the stopping of rotation of said second ratchet acting through said second spring clutch to stop the rotation of said toothed wheel, said paper feeding means including a shaft rotatably supported on said frame, a first gear rotatably disposed on said shaft, said first gear being rotated by said toothed wheel in said first and second directions, and a third spring clutch having two ends disposed on said shaft, a first end of said third spring clutch being coupled to said first gear, said third spring clutch causing said shaft to rotate when said first gear is rotated in one of said first and second directions, said paper feeding means further including an operation gear rotatably disposed on said frame in meshing engagement with said toothed wheel and an intermittent gear secured to said operation gear engaged with said first gear, said intermittent gear including a first locking portion, said first gear having a second locking portion which selectively engages with said first locking portion of said intermittent gear to stop the rotation of said shaft.

2. The printer as claimed in claim 1, wherein said paper feeding means includes a paper feeding roller secured on said shaft.

3. The printer as claimed in claims 1 or 2, wherein said platen release means includes a rotary cam rotatably disposed on said frame and driven by said toothed wheel, said platen including a cam follower engaged with said rotary cam.

4. The printer as claimed in claim 3, wherein said rotary cam is unitarily formed with said intermittent gear so that said paper feeding means does not feed said thermosensitive medium when said platen release means is pressing said platen to said printing head.

5. The printer as claimed in claim 4, wherein said platen means includes spring means coupled intermediate said platen and said frame for normally biasing said platen against said printing head.

6. The printer as claimed in claim 1 or 2, wherein said driving shaft includes a helical groove thereon, said printing head including a projection which rides in said helical groove.

* * * * *